US006575311B1

(12) United States Patent
Fink

(10) Patent No.: US 6,575,311 B1
(45) Date of Patent: Jun. 10, 2003

(54) GOLF CLUB DISPLAY RACK

(75) Inventor: Cheryl S. Fink, Floyds Knobs, IN (US)

(73) Assignee: Hillerich & Bradsby Co., Louisville, KY (US)

( * ) Notice: Subject to any disclaimer, the term of this patent is extended or adjusted under 35 U.S.C. 154(b) by 0 days.

(21) Appl. No.: 10/156,290

(22) Filed: May 28, 2002

Related U.S. Application Data

(60) Provisional application No. 60/351,629, filed on Jan. 24, 2002.

(51) Int. Cl.[7] ..... A47F 7/00

(52) U.S. Cl. ..... 211/70.2; 211/70.6; 211/87.01

(58) Field of Search ..... 211/70.2, 70.6, 211/60.1, 70.8, 87.01

(56) References Cited

U.S. PATENT DOCUMENTS

| | | | | |
|---|---|---|---|---|
| 553,445 A | | 1/1896 | Zimmerlin et al. | |
| 1,678,353 A | * | 7/1928 | Reach | |
| 1,719,360 A | | 7/1929 | Deike | |
| 1,849,610 A | | 3/1932 | Boyce | |
| 2,089,537 A | * | 8/1937 | Champlin | |
| 2,436,687 A | | 2/1948 | Corbett | |
| 2,577,988 A | * | 12/1951 | Wirth | |
| 2,754,008 A | * | 7/1956 | Culver | 211/60.1 |
| 3,721,348 A | * | 3/1973 | Cook | 211/70.6 |
| 4,027,799 A | * | 6/1977 | Studker | 211/59.1 X |
| 4,134,499 A | | 1/1979 | Joswig | |
| 4,200,131 A | * | 4/1980 | Chitwood et al. | 211/70.2 X |
| 4,421,240 A | * | 12/1983 | Connolly | 211/70.2 |
| 4,830,198 A | * | 5/1989 | Colquitt | 211/70.6 |
| 4,863,019 A | | 9/1989 | Lewis et al. | |
| 4,863,020 A | * | 9/1989 | Klemow | 211/60.1 X |
| 5,228,566 A | | 7/1993 | Shenoha | |
| 5,383,555 A | | 1/1995 | Weinmeier | |
| 5,505,316 A | | 4/1996 | Lee | |
| 5,526,941 A | * | 6/1996 | Ford | 211/59.1 |
| 5,611,440 A | | 3/1997 | Moller | |
| 5,617,951 A | | 4/1997 | Wick | |
| 5,620,091 A | | 4/1997 | Larson | |
| 5,678,700 A | * | 10/1997 | Crosson | 211/60.1 X |
| 6,041,947 A | | 3/2000 | Heneveld | |

* cited by examiner

*Primary Examiner*—Robert W. Gibson, Jr.
(74) *Attorney, Agent, or Firm*—Charles G. Lamb; Middleton Reutlinger

(57) ABSTRACT

A golf club display rack is disclosed wherein the clubs are held in place by an upper and lower support surface. The display rack holds the club heads in proper alignment by providing the upper and lower surface separate from each other while also combining retaining the club head in aligned position while providing a lower surface which retains the shaft in proper position. Thus, the rack may be a side turned U-shaped or C-shaped rack which allows the club head to rest thereon while the lower retaining surface has a compressible material to firmly retain the club shaft in position. The club rack display device of the present invention positions the clubs such that the club shafts may be maintained in parallel form.

15 Claims, 5 Drawing Sheets

GOLF CLUB DISPLAY RACK

CROSS REFERENCE TO RELATED APPLICATION

This is a utility patent application claiming priority of provisional patent application No. 60/351,629 filed Jan. 24, 2002.

BACKGROUND OF THE INVENTION

1. Field of the Invention

The present invention relates to a display rack for golf clubs. Specifically, the present invention is directed towards a golf club display rack which supports the golf clubs by the head of the golf club and allows the club shaft to hang there below in parallel fashion.

2. Review of the Prior Art

Many types of golf club display racks and golf club organizers are known in the prior art.

Most of the prior art golf club display racks which allow hanging of the golf club support the golf club by the golf club head thereby allowing the remaining portion of the club, namely the shaft, to hang there below. In such construction, the shaft hangs below the club head at varying angles in a very unorganized and unappealing manner. It is therefore desirous to have a golf club display rack which displays the golf clubs in an ordered and appealing manner to the eye.

SUMMARY OF THE INVENTION

The present invention is directed towards a golf club display rack which allows the golf clubs to be supported by the head of the golf club in an orderly and appealing fashion while also stabilizing the shaft so that the entire display organizes the shafts in a parallel manner.

The present invention further provides for a golf club display rack which supports the golf club at both a first and a second position.

It is therefore an object of the present invention to provide a golf club display rack which allows golf clubs to be supported by the club head while also allowing the golf club to be retained in parallel fashion without having to incorporate a secondary retaining mechanism to hold the club shaft.

An additional object of the present invention is to provide a golf club display rack which allows for ready support of the golf club head while firmly retaining the entire shaft in a pre-desired position.

An additional object of the present invention is to provide a golf club display rack wherein the display rack may have an upper support surface and a lower support surface wherein the upper support surface may support the golf club head and the lower support surface may retain the golf club shaft, and further wherein the entirety of the golf club display rack is integrated into a single compact support mechanism.

A further object of the present invention is to provide a golf club head alignment bar on a golf club display rack wherein the golf club head alignment bar organizes the golf club heads and allows the shafts to depend directly therefrom in an orderly fashion to be retained by a lower supporting surface.

An even further object of the present invention is to provide a golf club display rack which may be integrated on either a wall mounting position or in a stand alone rack mount position such that golf clubs may be displayed in parallel fashion and wherein a plurality of clubs may be readily displayed.

An additional object of the present invention is to provide a multi-leveled golf club display rack wherein a plurality of clubs may be readily displayed in organized fashions such that the golf club shafts remain in a parallel fashion to each other and wherein a plurality of levels for supporting the golf clubs may be provided in a single display rack.

The present invention provides for display of golf clubs in an organized fashion such that the golf club shafts are displayed in a parallel manner and such that the entirety of the display rack and support device is located near the head of the golf club.

The present invention is therefore directed towards a golf club display rack which may provide for a plurality of levels or tiers upon which golf clubs may be organized. The rack may be constructed as a side-turned U-shaped or C-shaped display assembly or rack, wherein an upper support surface holds the golf club head in place. Extending below the upper support surface may be a lower support surface which firmly retains the shaft of the club near the hosel of the club head. The lower support surface is constructed so as a portion thereof crimps or pinches the shaft and firmly holds it in place. This may be completed through the use of a layer of foam like compressible material which has a slot formed therein to receive the shaft. Thus, the club head is held in the rack and aligned by an alignment bar while the shaft is retained at a position near the hosel to maintain the shafts in congruent vertical position.

All of the above outlined objectives are to be understood as exemplary only and many more objectives of the invention may be gleaned from the disclosure herein. Therefore, no limiting interpretations of the objectives noted are to be understood without further reading of the entire specification and drawings included herewith.

DETAILED DESCRIPTION OF THE PREFERRED EMBODIMENT

Figure 1:
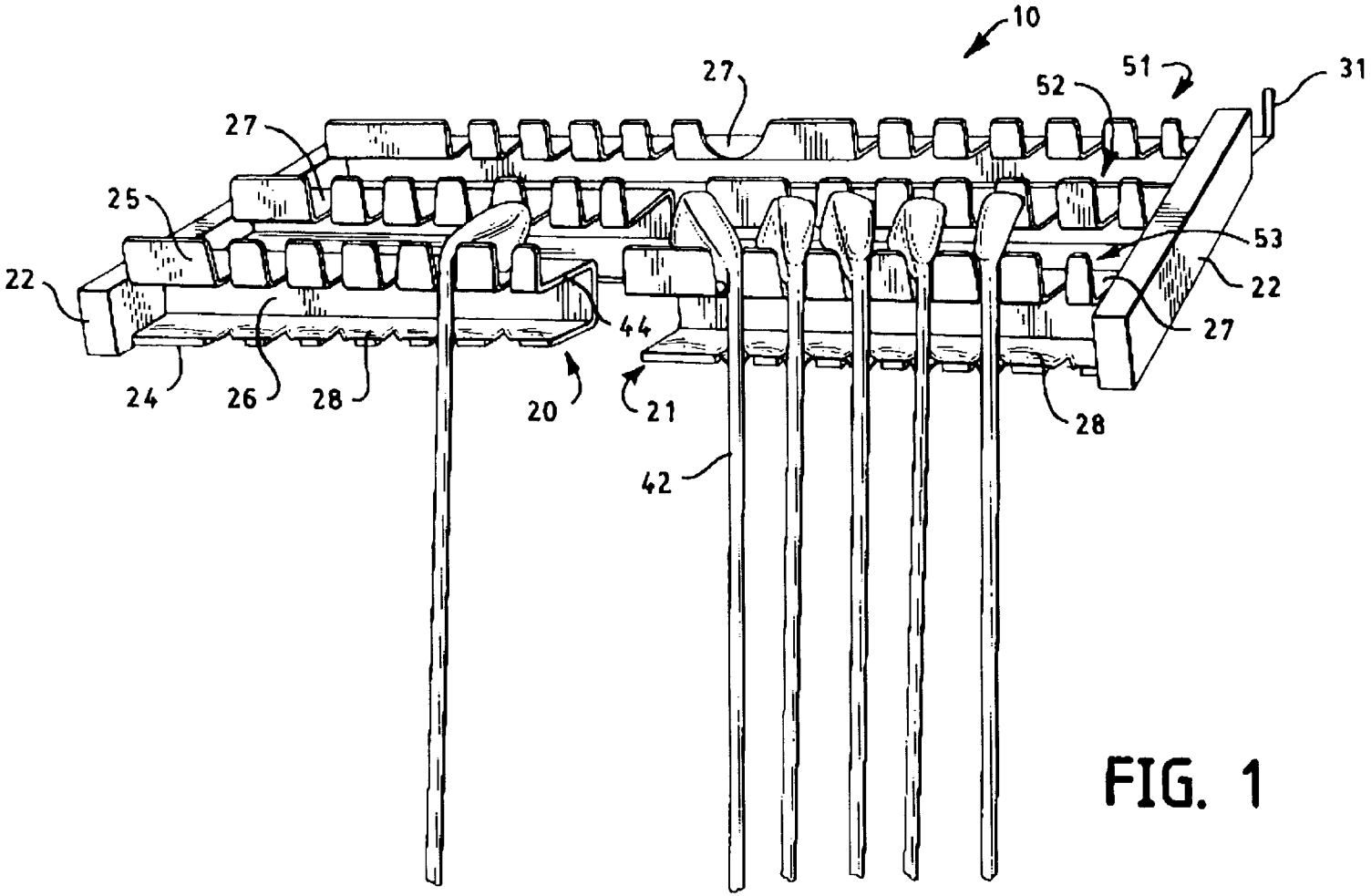
FIG. 1 is a perspective view of the golf club display rack of the present invention.

The golf club display rack 10 of the present invention is disclosed in FIG. 1. As shown therein, the golf club display rack may be comprised of a plurality of tiers 51, 52, 53. Each of the plurality of tiers may be comprised of left hand display racks 20 and right hand display racks 21 so that a gap may exist there between.

The golf club display rack 10 of the present invention as depicted in FIG. 1 shows how each of the left hand racks 20 and right hand racks 21 may be integrated with side frame members 22 so that golf clubs may be properly restrained therein, the club heads are fully supported and the shafts remain in parallel relationship.

Each of the left hand racks 20 and right hand racks 21 are similarly constructed so discussion of one may be applicable to the other. Additionally, as depicted in FIG. 1, the left hand rack and right hand rack, 20, 21 are shown with a separation there between. Alternatively, full length individual racks may be provided which extend entirely between side frame members 22. Such alternatives are considered to be within the teaching of the disclosure herein and no unnecessary limitations are to be interpreted from the examples shown in the figures.

Figure 2:
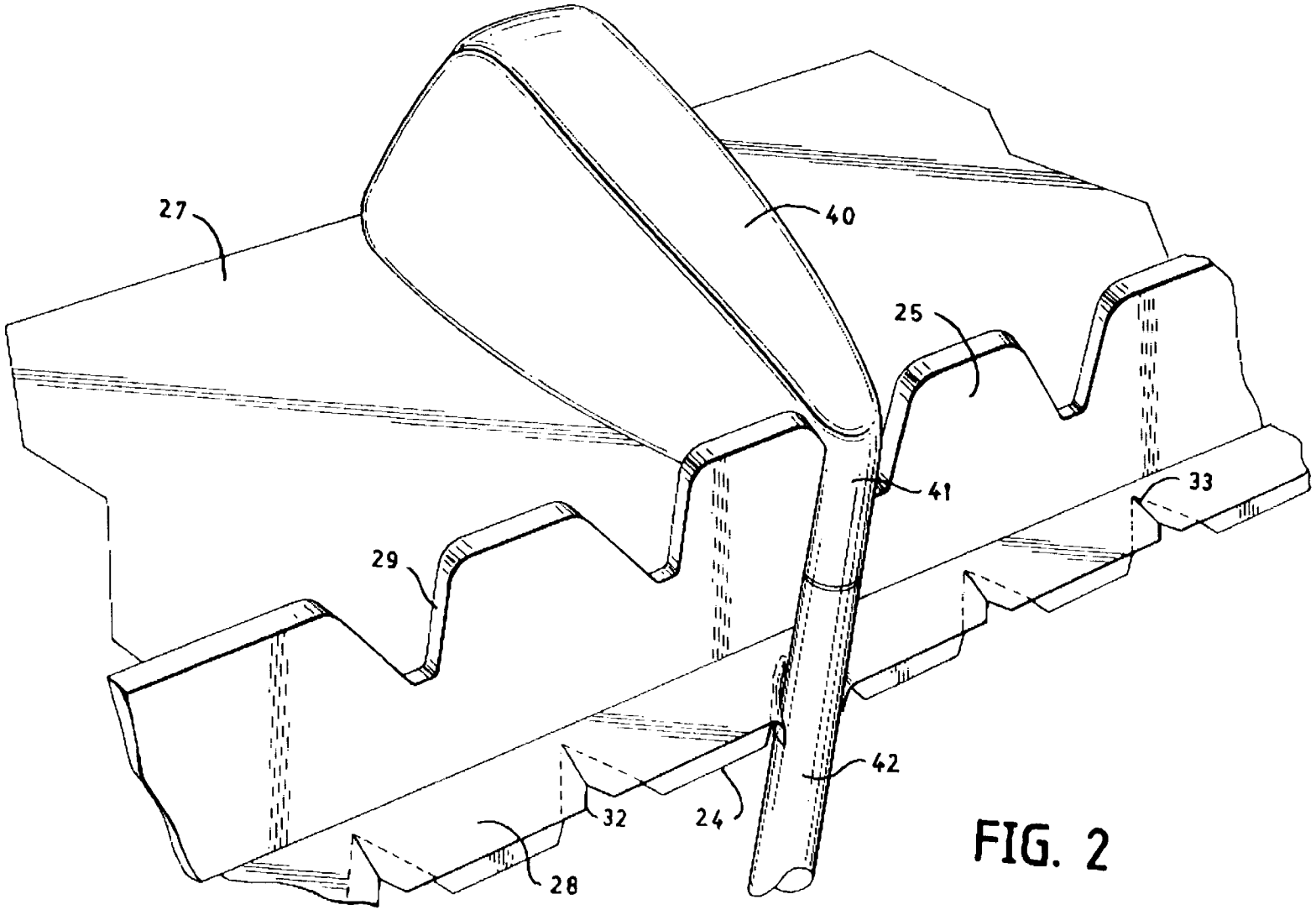
FIG. 2 is a top perspective close up view of the support structure for the golf club display rack shown in FIG. 1.
Figure 3:
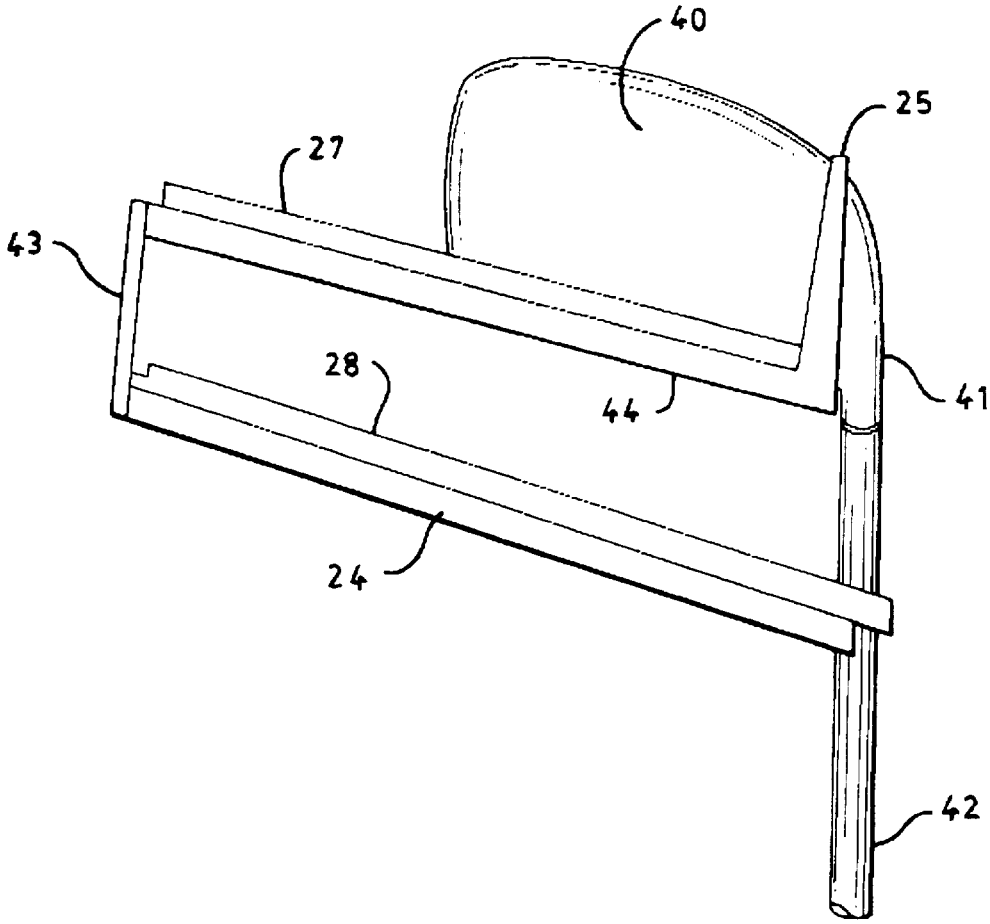
FIG. 3 is a side cut away view of the golf club display rack shown in FIG. 1.

As seen in FIG. 1, the left hand rack 20 is comprised of a side turned U-shaped or C-shaped structure or assembly which has an upper support surface 44, a lower support surface 24 and a rear wall 43 forming cavity 26 which may be seen in FIG. 3. The rear wall 43 extends between the upper support surface 44 and the lower support surface 24. The upper support surface 44 is provided such that it may support the golf club thereon as is shown in FIG. 2 and in FIG. 3. The golf club head 40 is supported by the upper support surface 44 and may additionally rest on the club support 27. The club support 27 may be an extra layer placed upon the upper support surface 44 in order to provide a soft surface for the golf club head 40 to rest upon. The club support 27 may be made of a foam, cloth or other material or may similarly be integrated directly with the upper support surface 44 such that a single integral surface is provided.

As seen in the figures, the upper support surface 44 extends outward from the rear wall 43 to a point where a club head alignment bar 25 extends upwardly therefrom. Thus, the golf supporting rack 20, depicted as a left hand rack in FIG. 1, is thus comprised of a club head alignment bar 25 which may be substantially vertical, an upper support surface 44 which extends rearward from said alignment bar 25 to a rear wall 43, the rear wall 43 extending downward therefrom then connecting to a lower support surface 24 which extends forward from said rear wall 43 and is spaced below said upper support surface 44. The golf club head alignment bar 25, which extends across the front or leading edge of the upper support surface 44, has a plurality of alignment notches 29 formed therein. As seen in FIG. 2, the alignment notches are sized such that the golf club head 40 may rest securely on the club support 27 while the hosel 41 extends outward from said alignment notch 29 allowing the golf club shaft 42 to depend downward therefrom. Thus, as seen in FIG. 2 and FIG. 3, the golf club shaft 42 is spaced outwardly from the alignment bar 25 and extends downwardly in front of the upper support surface 44.

Spaced below upper support surface 44 and separated therefrom by rear wall 43 is the lower support surface 24. The lower support surface 24 may have a retaining surface 28 formed thereon of an additional material similar to club support 27. Retaining surface 28 may be comprised of foam, cloth or other material or may again be integrated directly with lower support surface 24. As depicted in FIG. 3 and in FIG. 2, the lower support surface 24 extends outward in spaced relationship beyond the upper support surface 44. Retaining surface 28, as seen in FIG. 2, may extend nearly to the edge of lower support surface 24. Lower support surface 24 additionally has a plurality of notches 32 formed therein which receive the club shaft 42.

As seen in FIG. 2, the retaining surface 28 actually extends over the notch 32 of the lower support surface 24 and may have a slot 33 formed therein. One preferred slot 33 has an inward tapered configuration. In the embodiment shown in FIG. 2 and in FIG. 3, the retaining surface 28, if comprised of a foam or other compressible material, receives the golf club shaft 42 within the slot 33 to securely hold the shaft within the notch 32 such that the shafts of all of the clubs held within the golf club display rack 10 are in parallel form. The notch 32 formed in the lower support surface, which is separated from the upper support surface 44 by cavity 26 (FIG. 1) works in conjunction with alignment bar 25 so that the club head is securely retained against the upper support surface 44 in conjunction with retaining the club shaft 42.

As shown in FIG. 1 through FIG. 3, a plurality of clubs may be retained on each of the different levels or tiers 51, 52, 53 of the golf club display rack 10 of the present invention. Each of the levels of the golf club display rack, as mentioned above, may be comprised of either a left hand rack 20 and a right hand rack 21 or may be comprised of a singular rack extending between the side frame members 22. Each of the individual levels or tiers are separated from the next adjacent tier by a separation gap 45 shown in FIG. 5. Thus, as shown in the example of FIG. 1 and in conjunction with FIG. 5, top or first tier 51 is disposed behind and slightly above second level or tier 52 and separated by a gap 45, while second tier 52 is disposed above and slightly behind third or lower tier 53. Each of the tiers or levels is separated from the next adjacent level by the gap 45 so that the clubs may be readily inserted within the club head alignment bar 25 for each of the tiers 51, 52, 53.

Returning to FIG. 1 and the example shown therein, the golf club display rack 10 of the present invention is provided which supports a plurality of golf clubs. Each of the C-shaped racks 20 and 21 securely holds golf club shafts 42 in parallel relationship. As shown in conjunction with FIG. 4, the alignment bar 25 may have a plurality of alignment notches 29 thereon, each of the alignment notches sized so as to retain the hosel 41 in front thereof. The plurality of alignment notches 29 formed in the alignment bar 25 may be alternatively sized to varying degrees so that different size clubs may fit through an alignment notch 29 and the club head 40 may securely rest on the club support 27. Thus, as shown in FIG. 5, a smaller alignment notch 29 may be provided for clubs with a wider club head angle such as lofted clubs. Alternatively, narrow alignment notches 29 may be provided in the club support 27 for clubs wherein the club head 40 is near vertical. In any case, as depicted in the figures and particularly in FIG. 5, FIG. 3 and FIG. 2, the club support 27 allows the club head 40 to rest thereon and allows hosel 41 to extend outward through the alignment notch 29 formed in the alignment bar 25. Thus, the club shaft 42 may extend downwardly therefrom through the retaining surface 28 and the notch formed in the lower support surface 24 such that the retaining surface 28 partially wraps around the club shaft 42 and holds it securely in place. It may be preferable that the shaft 42 extends firmly within the slot 33 formed in surface 28. However, surface 28 may be formed such that grooves or slits are formed therein that may tightly retain the shaft 42, particularly when the retaining surface 28 is made of a compressible material such as a polyurethane foam or other known materials. Of import is that the shaft 42 is retained in place in a secure fashion such that the shaft 42 of the plurality of clubs retained on the golf club display rack 10 are held in parallel fashion in an organized form.

Figure 4:
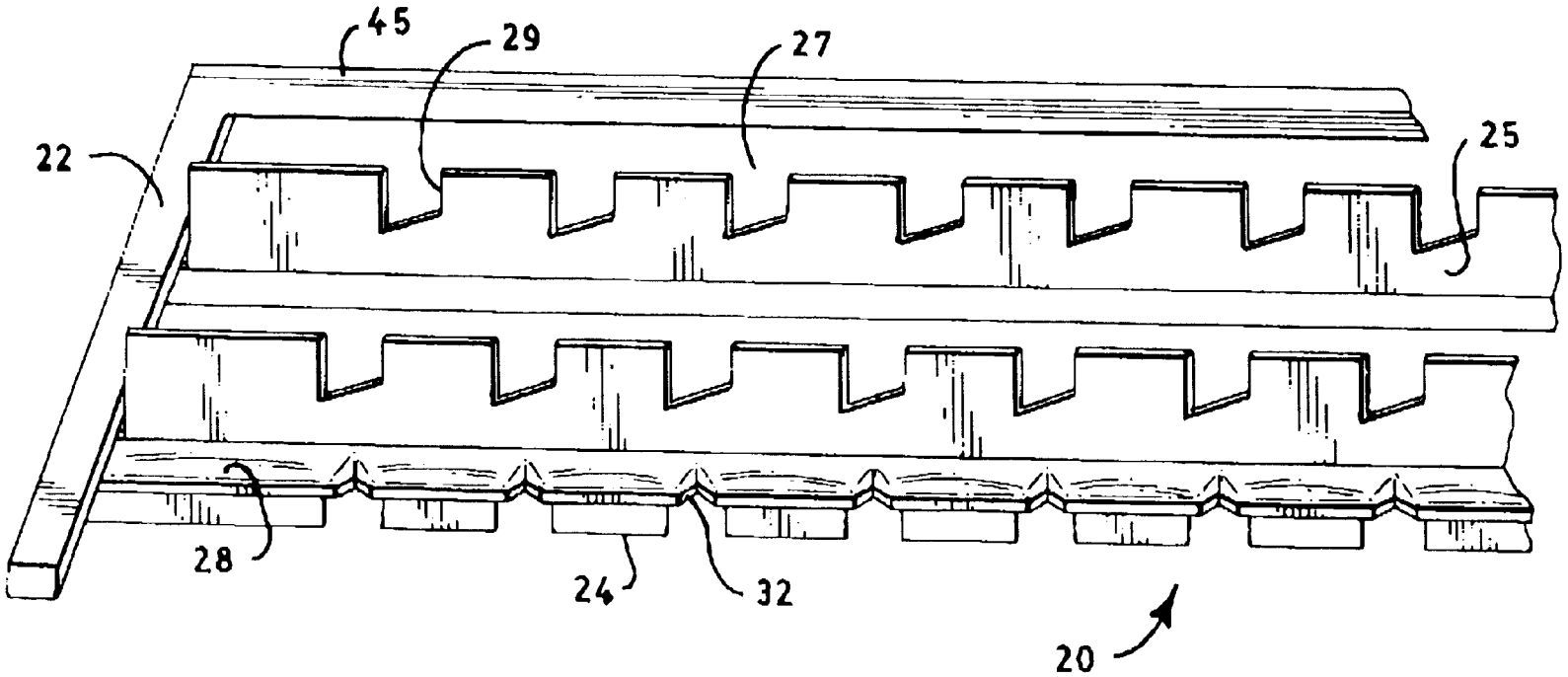
FIG. 4 is a front view of the golf club display rack of the present invention.
Figure 5:
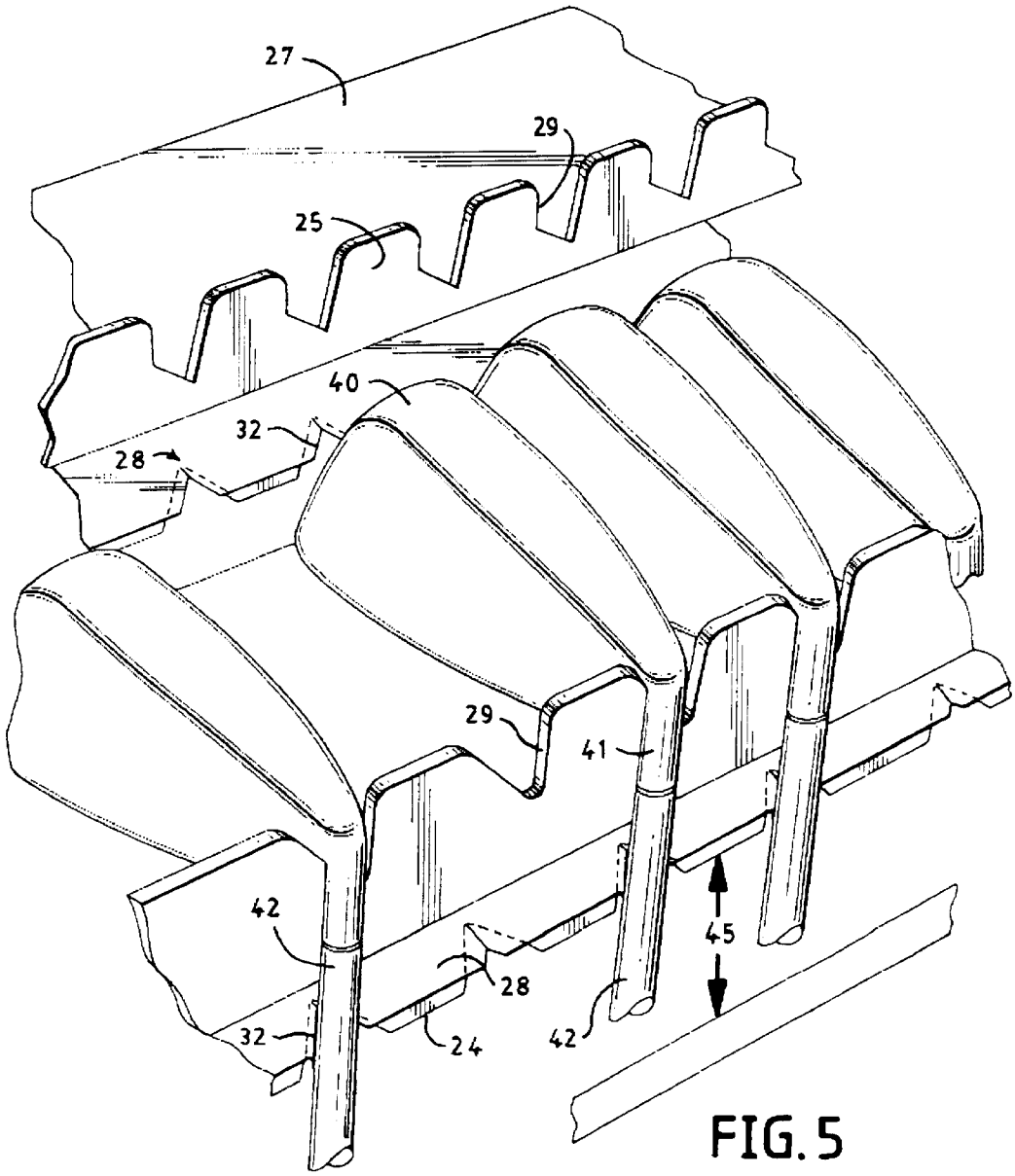
FIG. 5 is a close up perspective view of the golf club display rack of the present invention.

As shown in FIG. 4 and in the other examples, a plurality of tiers 51, 52 and 53 may be provided in order that a number of clubs may be displayed at various levels. Thus, the side frame 22 may extend upwardly at a slight angle from the forward most end to the rear most end. In such a format, each of the tiers are thereby placed one above the other such that each row or tier allows the one in front to be visible. Thus, the clubs retained on the lower most tier 53 do not get in the way of the view of any other clubs placed on the higher tiers.

Also as shown in FIG. 1, the golf club display rack may be secured to a number of support brackets 31 on the rear end of side frame member 22. Additionally, a rear support member may be provided extending behind the upper most tier 51 and between the side frame members 22. As shown in FIG. 1, the golf display rack 10 may be supported by a number of support brackets 31 located along a rear portion thereof. The support brackets 31 may be such that the golf display rack 10 may be mounted to a wall or other vertical surface. Additionally, the brackets may be provided for mounting on a stand alone support frame such that the display rack 10 is suspended or supported along a rear portion thereof and such that the golf clubs depend therebelow. The rear frame member 45 which extends between the side frames 22 shown in FIG. 4 may be used to fully or firmly support the display rack.

The golf club display rack 10 of the present invention is thus comprised of individual C-shaped racks which have an upper surface and a lower surface, the upper surface utilized to support the golf club head and the retaining surface utilized to secure the golf club shaft directly below the hosel such that the golf club shaft for a plurality of clubs supported on the rack are held in parallel fashion.

Many varying constructions may be utilized to retain the club head and shaft in relation such that the shaft if maintained in a vertical position. The display rack presented herein provides for congruent display of the clubs in an organized fashion such that the shafts are maintained vertically. The rack, while described herein as being of C-shaped construction, may also be an upper and a lower support surface which are in proper alignment with respect to each other in order to achieve the same functionality. Thus, such modifications are felt to be within the teachings herein and no unnecessary limitations are to be construed by the specific embodiments and examples disclosed.

What is claimed is:

1. A golf club display rack comprising:

an upper golf club head support surface spaced above a lower golf club shaft support surface;

a vertically extending member attaching said upper support surface with said lower support surface in a preselected spaced relationship;

the upper support surface having a front edge with an upward extending alignment bar extending along said front edge, said alignment bar having a plurality of spaced first notches therein, each first notch to receive a golf club head; and, said lower support surface having a front edge with a plurality of spaced second notches therein, each said second notch to receive a golf club shaft therein.

2. The display rack of claim 1, said upper golf club head support surface and said lower golf club shaft support surface forming a C-shaped display assembly.

3. The display rack of claim 2, including a plurality of C-shaped display assemblies in spaced parallel relationship and a pair of opposed side members, said opposed side members being attached to opposed ends of each C-shaped display assembly, said C-shaped display assemblies being in a preselected spaced relationship.

4. The display rack of claim 3, said side members being at an angle to said C-shaped display assemblies whereby each C-shaped display assembly is spaced vertically and at a preselected angle to adjacent C-shaped display assemblies.

5. The display rack of claim 1, said lower support surface front edge extending outwardly beyond a front edge of said upper support surface.

6. The display rack of claim 1, said first and said second notches being aligned in an angled vertical alignment.

7. The display rack of claim 1, said upper surface having a soft surface on a top thereof to receive said golf club head therein.

8. The display rack of claim 1, each said second notch having an inward tapered slot therein.

9. The display rack of claim 1, each said first notch being sized to retain a hosel of said golf club head in a front of each said first notch.

10. The display rack of claim 1, including wall mounting support brackets attached along rear edges of said upper support surface and said lower support surface.

11. The display rack of claim 1, said upper support surface and said lower support surface being a C-shaped display assembly of unitary construction.

12. A golf club display rack comprising:

a C-shaped display assembly having an upper golf club head support surface and a lower golf club shaft support surface, the upper support surface having a front edge with an upward extending alignment bar extending along said front edge, said alignment bar having a plurality of spaced first notches therein, each said first notch being sized to receive,a hosel of a golf club head in said front edge;

said lower surface having a front edge with a plurality of spaced second notches therein, each second notch receiving a golf club shaft therein, said lower support surface extending outwardly beyond said front edge of said alignment bar, each said second notch having an inward tapered slot therein, said first and said second notches being aligned in an angled vertical alignment.

13. The display rack of claim 12 including a plurality of C-shaped display assemblies in spaced parallel relationship and a pair of opposed side frame members being attached along opposite edges of said assemblies in a preselected spaced arrangement of said plurality of said C-shaped display assemblies.

14. The display rack of claim 13, said frame members being positioned at an angle to said C-shaped display assemblies whereby each C-shaped display assembly is in a spaced vertically angled position to adjacent C-shaped display assemblies.

15. The display rack of claim 1 including wall mounting support brackets attached along rear edges of said C-shaped display assembly.

* * * * *